US010451986B2

(12) United States Patent
Sano et al.

(10) Patent No.: US 10,451,986 B2
(45) Date of Patent: Oct. 22, 2019

(54) TONER

(71) Applicant: CANON KABUSHIKI KAISHA, Tokyo (JP)

(72) Inventors: Hitoshi Sano, Matsudo (JP); Takeshi Hashimoto, Moriya (JP); Masayuki Hama, Toride (JP); Ichiro Kanno, Kashiwa (JP); Yuto Onozaki, Saitama (JP); Akifumi Matsubara, Narashino (JP); Megumi Ikeda, Kashiwa (JP); Nozomu Komatsu, Toride (JP); Takakuni Kobori, Toride (JP); Hiroyuki Fujikawa, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/912,698

(22) Filed: Mar. 6, 2018

(65) Prior Publication Data

US 2018/0259867 A1 Sep. 13, 2018

(30) Foreign Application Priority Data

Mar. 10, 2017 (JP) ..... 2017-045568

(51) Int. Cl.
*G03G 9/087* (2006.01)
*G03G 9/097* (2006.01)

(52) U.S. Cl.
CPC ..... *G03G 9/08755* (2013.01); *G03G 9/09733* (2013.01)

(58) Field of Classification Search
CPC ..... G03G 9/08755; G03G 9/09733
See application file for complete search history.

(56) References Cited

U.S. PATENT DOCUMENTS 5,424,810 A 6/1995 Tomiyama et al.
5,464,722 A 11/1995 Tomiyama et al.
5,698,422 A * 12/1997 Sacripante ..... C08G 63/20 430/109.4
5,700,616 A 12/1997 Kasuya et al.
5,712,073 A 1/1998 Katada et al.
5,968,701 A 10/1999 Onuma et al.
5,972,553 A 10/1999 Katada et al.
6,002,895 A 12/1999 Kasuya et al.
6,007,957 A 12/1999 Kobori et al.
6,020,102 A 2/2000 Fujimoto et al.
6,120,961 A 9/2000 Tanikawa et al.
6,156,471 A 12/2000 Kobori et al.
6,203,959 B1 3/2001 Tanikawa et al.
6,235,441 B1 5/2001 Tanikawa et al.
6,430,384 B2 8/2002 Hama et al.
6,653,036 B1 11/2003 Tanikawa et al.
6,670,087 B2 12/2003 Fujikawa et al.
6,751,424 B2 6/2004 Komatsu et al.
6,808,852 B2 10/2004 Hotta et al.
7,112,395 B2 9/2006 Ida et al.
7,135,263 B2 11/2006 Kawakami et al.
7,147,980 B2 12/2006 Itakura et al.
7,147,981 B2 12/2006 Fujikawa et al.
7,229,727 B2 6/2007 Itakura et al.
7,279,262 B2 10/2007 Fujikawa et al.
7,288,348 B2 10/2007 Hayami et al.
7,297,455 B2 11/2007 Fujikawa et al.
7,300,733 B2 11/2007 Sugahara et al.
7,396,626 B2 7/2008 Fujikawa et al.
7,442,478 B2 10/2008 Itakura et al.
7,452,647 B2 11/2008 Hayami et al.
7,611,813 B2 11/2009 Ida et al.
7,855,042 B2 12/2010 Kobori et al.
7,858,283 B2 12/2010 Ishigami et al.
7,927,775 B2 4/2011 Komatsu et al.
7,939,233 B2 5/2011 Inoue et al.
8,137,886 B2 3/2012 Baba et al.
8,142,972 B2 3/2012 Hotta et al.
8,288,069 B2 10/2012 Fujikawa et al.
8,921,023 B2 12/2014 Baba et al.
8,927,188 B2 1/2015 Naka et al.
8,986,914 B2 3/2015 Fujikawa et al.
9,034,549 B2 5/2015 Shiotari et al.
9,058,924 B2 6/2015 Komatsu et al.
9,063,443 B2 6/2015 Ishigami et al.
9,152,088 B1 10/2015 Kobori et al.
9,348,253 B2 5/2016 Kanno et al.
9,372,420 B2 6/2016 Mizo et al.
9,417,540 B2 8/2016 Hashimoto et al.
9,500,975 B2 11/2016 Sugahara et al.
9,594,323 B2 3/2017 Fujikawa et al.
9,599,920 B2 3/2017 Sugahara et al.
9,651,883 B2 5/2017 Hama et al.
9,665,021 B2 5/2017 Ohtsu et al.
9,665,023 B2 5/2017 Kamae et al.
9,665,026 B2 5/2017 Iwasaki et al.
9,671,707 B2 6/2017 Minagawa et al.
9,701,833 B2 * 7/2017 Sugimoto ..... G03G 9/08755
9,778,598 B2 10/2017 Onozaki et al.
9,958,809 B2 5/2018 Sugahara et al.
2009/0246675 A1 10/2009 Nakamura et al.
2010/0028796 A1 2/2010 Nakamura et al.
(Continued)

FOREIGN PATENT DOCUMENTS

JP 2006-330278 12/2006
JP 2006-330392 12/2006
(Continued)

OTHER PUBLICATIONS

Machine Translation of JP2013-195926, parts A1, A2.*
(Continued)

*Primary Examiner* — Thorl Chea
(74) *Attorney, Agent, or Firm* — Venable LLP

(57) ABSTRACT

According to the present invention, in a toner including a toner particle containing a binder resin and a low molecular aromatic hydrocarbon, the binder resin contains a polyester resin, at least one kind of a unit derived from an aromatic monocarboxylic acid and a unit derived from an aromatic monoalcohol is contained, and the low molecular aromatic hydrocarbon has 1 or more and 4 or less benzene rings, and has a melting point of 60° C. or more and 120° C. or less.

4 Claims, 1 Drawing Sheet

(56) References Cited

U.S. PATENT DOCUMENTS

| | | | |
|---|---|---|---|
| 2010/0183971 | A1 | 7/2010 | Fujikawa et al. |
| 2013/0244159 | A1 | 9/2013 | Ishigami et al. |
| 2014/0134535 | A1 | 5/2014 | Baba et al. |
| 2014/0137428 | A1 | 5/2014 | Takenaka et al. |
| 2014/0329176 | A1 | 11/2014 | Kanno et al. |
| 2016/0109820 | A1 | 4/2016 | Hashimoto et al. |
| 2016/0363877 | A1 | 12/2016 | Hama et al. |
| 2017/0315461 | A1 | 11/2017 | Komatsu et al. |
| 2017/0315463 | A1 | 11/2017 | Onozaki et al. |
| 2017/0343911 | A1 | 11/2017 | Hashimoto et al. |
| 2017/0357168 | A1 | 12/2017 | Kanno et al. |

FOREIGN PATENT DOCUMENTS

| | | | |
|---|---|---|---|
| JP | 2011-123352 | | 6/2011 |
| JP | 2013-195926 | * | 9/2013 |

OTHER PUBLICATIONS

U.S. Appl. No. 15/807,766, filed Nov. 9, 2017, Yuto Onozaki.
U.S. Appl. No. 15/813,713, filed Nov. 15, 2017, Yuto Onozaki.
U.S. Appl. No. 15/886,965, filed Feb. 2, 2018, Takeshi Hashimoto.
U.S. Appl. No. 15/955,291, filed Apr. 17, 2018, Megumi Ikeda.

* cited by examiner

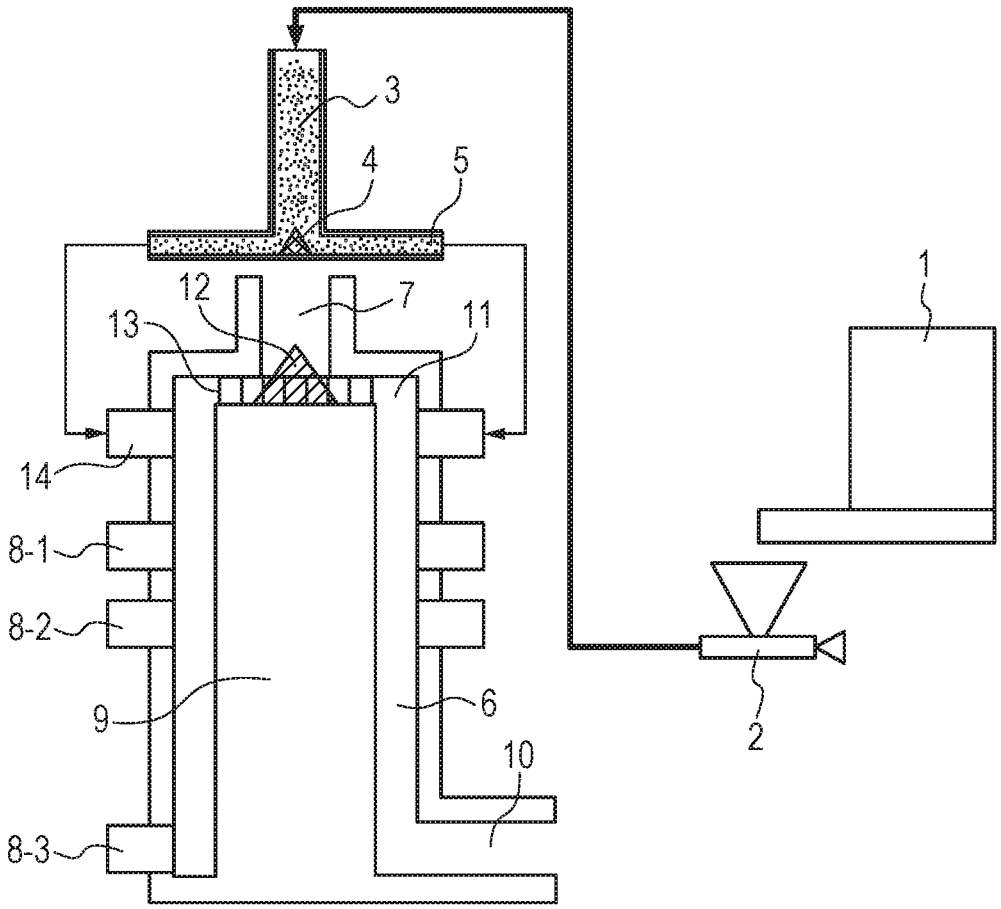
3
4
5
12
7
13
11
1
14
8-1
8-2
9
6
2
10
8-3

TONER

BACKGROUND OF THE INVENTION

Field of the Invention

The present invention relates to a toner used for an electrophotographic system, an electrostatic recording system, an electrostatic printing system, or a toner jet system.

Description of the Related Art

In recent years, an electrophotographic full-color copying machine has been widely spread, and the application to a printing market has also begun. In a printing market, high speed, high image quality, and high productivity have been required while responding to a wide range of media (paper type). For example, media constant velocity, which enables continuous printing without changing the process speed depending on the paper type or without changing the heating set temperature of a fixing device even if the paper type is changed from thick paper to thin paper, is required. In order to correspond to the media constant velocity, toner has been required to properly complete the fixing within a wide fixing temperature range from low temperature to high temperature.

In Japanese Patent Application Laid-Open No. 2011-123352, there is a description of a toner that has been improved in the low-temperature fixing performance with the addition of a crystalline resin having a sharp melt property to the toner in order to complete the fixing in a wide fixable temperature range.

However, the low-temperature fixability is improved, but when the toner is left to stand under the environment of high temperature and high humidity for a long period of time, the charge quantity is lowered, and toner scattering may occur. Further, when the toner is exposed to a high-temperature environment, recrystallization of the crystalline polyester proceeds, the toner properties are changed, and the low-temperature fixability may be deteriorated.

Furthermore, in Japanese Patent Application Laid-Open No. 2006-330392, there is a description of a toner that has been improved in the low-temperature fixability with the addition of an organic compound with a low molecular weight to the toner as a plasticizer.

However, the organic compound with a low molecular weight bleeds with the micro-Brownian motion of a resin, and the fixability may be impaired. In addition, there was a case where a compound bleeding due to long-term use contaminates the magnetic carriers or the charging members, the charge quantity is lowered, and the image storage stability is deteriorated.

In Japanese Patent Application Laid-Open No. 2006-330278, there is a description of a toner in which a low molecular aromatic compound is added as an organic compound with a low molecular weight.

However, the low-temperature fixability is improved, but the improvement of the charge stability is not recognized.

As described above, in order to obtain a toner that is excellent in the low-temperature fixability, and satisfies the charge stability in long-term use, there is still room for study.

SUMMARY OF THE INVENTION

The present invention has been made in view of the problems described above, and an object of the present invention is to provide a toner that is excellent in the low-temperature fixability, and has the charge stability in long-term use.

The present invention relates to a toner, including a toner particle containing a binder resin and a low molecular aromatic hydrocarbon, the binder resin containing a polyester resin, the polyester resin having at least one kind of a unit derived from an aromatic monocarboxylic acid and a unit derived from an aromatic monoalcohol, the low molecular aromatic hydrocarbon having 1 or more and 4 or less benzene rings, and the low molecular aromatic hydrocarbon having a melting point of 60° C. or more and 120° C. or less.

According to the present invention, a toner that is excellent in the low-temperature fixability and is charge stable in long-term use can be obtained.

Further features of the present invention will become apparent from the following description of exemplary embodiments with reference to the attached drawing.

BRIEF DESCRIPTION OF THE DRAWINGS

FIG. 1 is an explanatory drawing of a surface treatment device of toner.

DESCRIPTION OF THE EMBODIMENTS

Hereinafter, the embodiment for carrying out the present invention will be described in detail.

The present inventors have found that in a toner including a toner particle containing a binder resin and a low molecular aromatic hydrocarbon, when the binder resin contains a polyester resin, the polyester resin has at least one kind of a unit derived from an aromatic monocarboxylic acid and a unit derived from an aromatic monoalcohol, the low molecular aromatic hydrocarbon has 1 or more and 4 or less benzene rings, and the melting point of the low molecular aromatic hydrocarbon is 60° C. or more and 120° C. or less, a toner that is excellent in the low-temperature fixability and is charge stable in long-term use can be obtained.

With regard to the action effect due to the use of the toner having such a constitution, the present inventors consider as follows.

In the present invention, it is important to incorporate a low molecular aromatic hydrocarbon into a toner particle together with a binder resin containing a polyester resin that has at least one kind of a unit derived from an aromatic monocarboxylic acid and a unit derived from an aromatic monoalcohol.

It has been confirmed that by using the low molecular aromatic hydrocarbon in combination with the above binder resin, the low-temperature fixability and the charge stability in long-term use are improved.

According to this, it is considered that by using the low molecular aromatic hydrocarbon in combination with the above binder resin, the low molecular aromatic hydrocarbon is confined to the inside of the binder resin, and the bleed out can be suppressed. That is, it is considered that the binder resin plays a role to stabilize the low molecular aromatic hydrocarbon in the inside of the binder resin.

The binder resin contains a polyester resin, and a terminal of the polymer constituting the polyester resin is composed of an aromatic compound. Since the polymer terminal of the polyester resin is composed of an aromatic compound, the terminal of the polymer and the low molecular aromatic hydrocarbon can interact with each other. It is considered that the interaction serves as an anchor effect for suppressing the bleed out of the low molecular aromatic hydrocarbon.

In addition, the low molecular aromatic hydrocarbon has a small molecular size and is less sterically hindered, therefore, can enter between molecular chains of the binder resin. Accordingly, by widening the distance between the molecular chains, the interaction between molecules is suppressed. As a result, it is considered that the low molecular aromatic hydrocarbon can impart a plasticizing effect to the binder resin.

According to the mechanism shown above, it is presumed that a toner that is excellent in the low-temperature fixability and has the charge stability in long-term use can be provided.

In the present invention, for achieving the object, the constitution of a preferable toner will be described in detail below.

For the low molecular aromatic hydrocarbon, an endothermic peak (melting point) is observed in differential scanning calorimetry (DSC), and the melting point is in the range of 60° C. or more and 120° C. or less. In this way, improvement in the low-temperature fixability is achieved. The low molecular aromatic hydrocarbon may be used alone or in combination of two or more kinds thereof. It is preferred from the viewpoint of the charge stability that the content of the low molecular aromatic hydrocarbon in a toner particle is 0.1 part by mass or more and 10.0 parts by mass or less based on 100.0 parts by mass of the binder resin.

The low molecular aromatic hydrocarbon has 1 or more and 4 or less benzene rings. As the low molecular aromatic hydrocarbon having 1 or more and 4 or less benzene rings, a compound represented by any one of the following formulas (1) to (9) can be mentioned.

[Chemical formulas (1) to (9)]

(1)

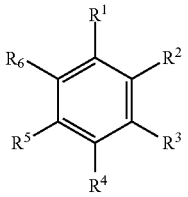

(2)

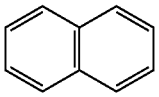

(3)

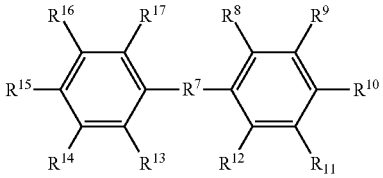

-continued (4)

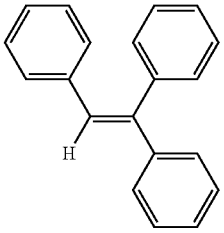

(5)

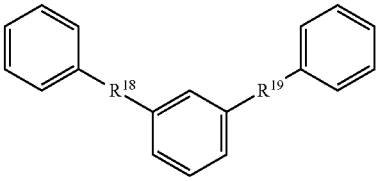

(6)

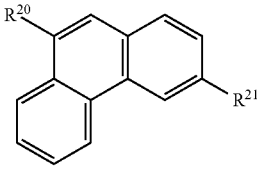

(7)

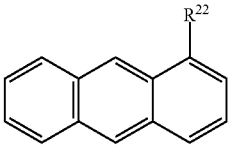

(8)

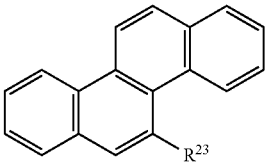

(9)

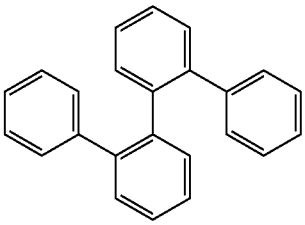

In the above-described formulas (1), (3), (5), (6), (7) and (8), $R^1$ to $R^6$, $R^8$ to $R^{17}$, and $R^{20}$ to $R^{23}$ each independently represent a hydrogen atom, an alkyl group, or an alkenyl group. $R^7$, $R^{18}$, and $R^{19}$ each independently represent a single bond, an alkylene group, or an alkenylene group.

More specifically, the low molecular aromatic hydrocarbon is compounds 1 to 16 described in Table 1 described later, which are used in Examples.

The polyester resin is a polycondensate of an alcohol component containing an aromatic diol as the main component and a carboxylic acid component. The polyester resin further has a unit derived from an aromatic monocarboxylic acid and/or a unit derived from an aromatic monoalcohol.

As the aromatic diol used in the polyester resin, it is not particularly limited, and a bisphenol derivative represented by the following formula (a) and diols represented by the following formula (b) can be mentioned.

[Chemical formula (a)]

(a)

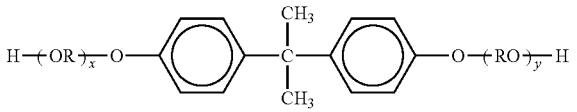

(In formula (a), R represents an ethylene or propylene group, x and y each are an integer of 1 or more, and an average value of x+y is 2 or more and 7 or less.)

[Chemical formula (b)]

(b)

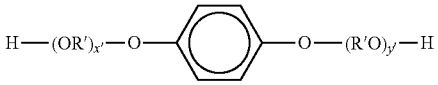

(In formula (b), R' represents —$CH_2CH_2$—,

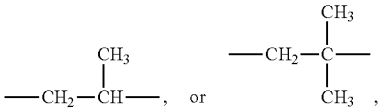

x' and y' each are an integer of 0 or more, and an average value of x'+y' is 0 or more and 10 or less.)

Examples of the bisphenol derivative represented by the above formula (a) include polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, and polyoxy propylene(6)-2,2-bis(4-hydroxyphenyl)propane. Further, for example, diols such as ethylene glycol, diethylene glycol, triethylene glycol, 1,2-propylene glycol, 1,3-propylene glycol, 1,4-butanediol, neopentyl glycol, 1,4-butenediol, 1,5-pentanediol, and 1,6-hexanediol, and diols such as bisphenol A, and hydrogenated bisphenol A may be used in combination with the bisphenol derivative represented by the above formula (a) or the diols represented by the above formula (b).

Examples of the aromatic monoalcohol include phenol, ethylphenol, isobutylphenol, pentylphenol, octylphenol, dodecylphenol, tetradecylphenol, and benzyl alcohol. Note that the aromatic monoalcohol may be used alone, or in combination of two or more kinds thereof.

In addition, as an alcohol component that can be used for a polyester resin, ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, sorbitol, 1,2,3,6-hexantetrol, 1,4-sorbitan, pentaerythritol, dipentaerythritol, tripentaerythritol, 1,2,4-butanetriol, 1,2,5-pentanetriol, glycerin, 2-methylpropanetriol, 2-methyl-1,2,4-butanetriol, trimethylolethane, trimethylolpropane, and 1,3,5-trihydroxymethylbenzene can be mentioned.

As described above, the main component of the alcohol component constituting the polyester resin is an aromatic diol. Herein, in the alcohol component constituting the polyester resin, the aromatic diol is contained in a proportion of 80% by mole or more and 100% by mole or less, and is preferably contained in a proportion of 90% by mole or more and 100% by mole or less.

As the polyvalent carboxylic acid monomer used for the polyester unit of the polyester resin, the following polyvalent carboxylic acid monomers may be used.

Examples of the divalent carboxylic acid component include maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenyl succinic acid, isododecenyl succinic acid, n-dodecyl succinic acid, isododecyl succinic acid, n-octenyl succinic acid, n-octyl succinic acid, isooctenyl succinic acid, isooctyl succinic acid, anhydrides of these acids, and lower alkyl esters thereof. Among them, maleic acid, fumaric acid, terephthalic acid, and n-dodecenyl succinic acid are preferably used.

Examples of the monocarboxylic acid component include benzoic acid, vinylbenzoic acid, toluic acid, dimethylbenzoic acid, t-butyl benzoic acid, cumic acid, naphthoic acid, biphenyl monocarboxylic acid, and furoic acid.

As a trivalent or higher carboxylic acid, and the acid anhydride or lower alkyl ester thereof, for example, 1,2,4-benzene tricarboxylic acid, 2,5,7-naphthalene tricarboxylic acid, 1,2,4-naphthalene tricarboxylic acid, 1,2,4-butane tricarboxylic acid, 1,2,5-hexane tricarboxylic acid, 1,3-dicarboxyl-2-methyl-2-methylene carboxy propane, 1,2,4-cyclohexane tricarboxylic acid, tetra(methylene carboxyl) methane, 1,2,7,8-octane tetracarboxylic acid, pyromellitic acid, Empol trimer acid, and acid anhydrides or lower alkyl esters thereof can be mentioned. Among them, particularly 1,2,4-benzene tricarboxylic acid, that is, trimellitic acid or a derivative thereof is inexpensive and easy to control the reaction, therefore, is preferably used. These divalent carboxylic acids and the like and trivalent or higher carboxylic acids can be used alone or in multiple in combination.

The polyester resin may be a hybrid resin containing other resin components as long as it contains a polyester resin as the main component. For example, a hybrid resin of a polyester resin and a vinyl-based resin can be mentioned. As the method for obtaining a reaction product of a vinyl-based resin or a vinyl-based copolymer unit and a polyester resin, such as a hybrid resin, a method in which a polymerization reaction of either one or both of the resins is performed in the presence of a polymer containing a monomer component that can react with each of the vinyl-based resin or the vinyl-based copolymer unit, and the polyester resin is preferred.

For example, among the monomers constituting the polyester resin component, as the one capable of reacting with a vinyl-based copolymer, for example, unsaturated dicarboxylic acid such as fumaric acid, maleic acid, citraconic acid, and itaconic acid, anhydrides thereof, and the like can be mentioned. Among the monomers constituting the vinyl-based copolymer component, as the one capable of reacting with a polyester resin component, one having a carboxyl group or a hydroxy group, and acrylic acid or methacrylic acid esters can be mentioned.

Further, as the polyester resin, as long as the polyester resin is contained as the main component, in addition to the above vinyl-based resins, various resins may be used in combination. Examples of the resin described above include a phenol resin, a natural resin-modified phenol resin, a natural resin-modified maleic resin, an acrylic resin, a methacryl resin, a polyvinyl acetate resin, a silicone resin, a polyester resin, polyurethane, a polyamide resin, a furan resin, an epoxy resin, a xylene resin, polyvinyl butyral, a terpene resin, a coumarone-indene resin, and a petroleum-based resin.

The polyester resin can be produced in accordance with an ordinary polyester synthesis method. For example, a desired polyester resin can be obtained by subjecting the above-described carboxylic acid monomer and alcohol monomer to an esterification reaction or a transesterification reaction, and then by subjecting the reactant to a polycondensation reaction under reduced pressure or introduction of nitrogen gas in the usual manner.

The esterification or transesterification reaction may be performed by using a common esterification catalyst or transesterification catalyst such as sulfuric acid, titanium butoxide, dibutyl tin oxide, manganese acetate, or magnesium acetate, as needed.

Further, the above-described polycondensation reaction may be performed by using an ordinary polymerization catalyst, for example, a catalyst such as titanium butoxide, dibutyl tin oxide, tin acetate, zinc acetate, tin disulfide, antimony trioxide, or germanium dioxide.

In addition, the polyester resin may be used by mixing a high molecular weight polyester resin (H) with a low molecular weight polyester resin (L). It is preferred from the viewpoint of the low-temperature fixability and the hot offset resistance that the content ratio (H/L) of the high molecular weight polyester resin (H) to the polyester resin (L) is 10/90 or more and 60/40 or less on a mass basis.

It is preferred from the viewpoint of the hot offset resistance that the peak molecular weight of the high molecular weight polyester resin (H) is 10000 or more and 20000 or less. Further, it is preferred from the viewpoint of the charge stability under the environment of high temperature and high humidity that the acid value of the high molecular weight polyester resin (H) is 15 mgKOH/g or more and 30 mgKOH/g or less.

It is preferred from the viewpoint of the low-temperature fixability that the number average molecular weight of the low molecular weight polyester resin (L) is 1500 or more and 3500 or less. Further, it is preferred from the viewpoint of the charge stability under the environment of high temperature and high humidity that the acid value of the low molecular weight polyester resin (L) is 10 mgKOH/g or more and 25 mgKOH/g or less. Furthermore, it is preferred from the viewpoint of the low-temperature fixability and the storage stability that the hydroxyl value of the binder resin is 2 mgKOH/g or more and 20 mgKOH/g or less.

As the hydrocarbon-based wax used for the toner, for example, a low molecular weight alkylene polymer obtained by radically polymerizing alkylene under high pressure or by polymerizing alkylene with a Ziegler catalyst or a metallocene catalyst under low pressure; an alkylene polymer obtained by thermally decomposing a high molecular weight alkylene polymer; and a synthetic hydrocarbon wax obtained from the distillation residues of hydrocarbon obtained by an Arge method from a synthesis gas containing carbon monoxide and hydrogen, or obtained by hydrogenating the distillation residues of hydrocarbon are included. Further, a wax obtained through fractionation of hydrocarbon wax by a press sweating method, a solvent method, use of vacuum distillation, or a fractional crystallization system is more preferably used. As for the hydrocarbon as a base body, it is preferred to use a hydrocarbon synthesized by a reaction between carbon monoxide and hydrogen using a metal oxide-based catalyst (a multiple system formed of two or more kinds of elements in many cases) [for example, a hydrocarbon compound synthesized by a synthol method, or a hydrocol method (use of a fluid catalyst bed)]; a hydrocarbon having up to around several hundreds of carbon atoms obtained by an Arge method (use of an identification catalyst bed) with which a large amount of waxy hydrocarbon can be obtained; or a hydrocarbon obtained by polymerizing an alkylene such as ethylene with a Ziegler catalyst because of being a saturated long linear hydrocarbon with a small number of small branches.

A wax synthesized particularly by a method not involving the polymerization of alkylene is preferred also in view of the molecular weight distribution. Further, a paraffin wax is also preferably used. From the viewpoint of improving the low-temperature fixability and the hot offset resistance, a hydrocarbon-based wax such as a paraffin wax, and a Fischer-Tropsch wax is preferred.

The wax is preferably used in an amount of 1 part by mass or more and 20 parts by mass or less per 100 parts by mass of the binder resin.

In addition, in the endothermic curve during temperature rise as measured by a differential scanning calorimetry (DSC) device, the peak temperature of the highest endothermic peak of the wax is preferably 45° C. or more and 140° C. or less. When the peak temperature of the highest endothermic peak of the wax is within the above range, the peak temperature is preferred because both of the blocking resistance and the hot offset resistance of the toner can be achieved.

As the coloring agent to be contained in a toner particle, the following ones can be mentioned.

As the black coloring agent, carbon black, and one toned to a black color by using yellow, magenta, and cyan coloring agents can be mentioned. As the coloring agent, a pigment may be used alone, but it is more preferred to improve the sharpness by using a dye and a pigment in combination from the viewpoint of the image quality of a full-color image.

As the pigment for magenta toner, the following ones can be mentioned.

C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238, 269, and 282; C.I. Pigment Violet 19; and C.I. Vat Red 1, 2, 10, 13, 15, 23, 29, and 35.

As the dye for magenta toner, the following ones can be mentioned.

An oil-soluble dye such as C.I. Solvent Red 1, 3, 8, 23, 24, 25, 27, 30, 49, 81, 82, 83, 84, 100, 109, and 121; C.I. Disperse Red 9; C.I. Solvent Violet 8, 13, 14, 21, and 27; and C.I. Disperse Violet 1, and a basic dye such as C.I. Basic Red 1, 2, 9, 12, 13, 14, 15, 17, 18, 22, 23, 24, 27, 29, 32, 34, 35, 36, 37, 38, 39, and 40; and C.I. Basic Violet 1, 3, 7, 10, 14, 15, 21, 25, 26, 27, and 28.

As the pigment for cyan toner, the following ones can be mentioned.

C.I. Pigment Blue 2, 3, 15:2, 15:3, 15:4, 16, and 17; C.I. Vat Blue 6; C.I. Acid Blue 45, and a copper phthalocyanine pigment in which 1 to 5 phthalimide methyl groups are substituted in the phthalocyanine skeleton.

As the dye for cyan toner, there is C.I. Solvent Blue 70.

As the pigment for yellow toner, the following ones can be mentioned.

C.I. Pigment Yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181, and 185; and C.I. Vat Yellow 1, 3, and 20.

As the dye for yellow toner, C.I. Solvent Yellow 162 can be mentioned.

The content of the coloring agent in a toner particle is preferably 0.1 part by mass or more and 30 parts by mass or less based on 100 parts by mass of the binder resin.

The toner particle may contain a charge control agent, as needed. As the charge control agent to be contained in a toner particle, in particular, a metal compound of an aromatic carboxylic acid, which is colorless, has a high charging speed of toner, and can stably retain a constant charge quantity, is preferred.

Examples of the negative charge control agent include a salicylic acid metal compound, a naphthoic acid metal compound, a dicarboxylic acid metal compound, a polymer-type compound having sulfonic acid or carboxylic acid in the side chain, a polymer-type compound having a sulfonic acid salt or an esterified sulfonic acid in the side chain, a polymer-type compound having a carboxylic acid salt or an esterified carboxylic acid in the side chain, a boron compound, a urea compound, a silicon compound, and a calixarene. Examples of the positive charge control agent include a quaternary ammonium salt, a polymer-type compound having the quaternary ammonium salt in the side chain, a guanidine compound, and an imidazole compound. The charge control agent may be added to a toner particle internally, or externally. The addition amount of the charge control agent is preferably 0.05 part by mass or more and 10 parts by mass or less based on 100 parts by mass of the binder resin.

The toner may contain inorganic fine particles, as needed. The inorganic fine particles may be internally added to a toner particle, or may be mixed with toner particles as an external additive. As the external additive, inorganic fine particles such as silica fine particles, titanium oxide fine particles, and aluminum oxide fine particles are preferred. The inorganic fine particles are preferably hydrophobized with a hydrophobizing agent such as a silane compound, a silicone oil, or a mixture thereof.

As the external additive for improving the flowability, inorganic fine particles having a BET specific surface area of 50 $m^2/g$ or more and 400 $m^2/g$ or less are preferred, and for stabilizing the durability, inorganic fine particles having a BET specific surface area of 10 $m^2/g$ or more and 50 $m^2/g$ or less are preferred. In order to achieve both of the improvement of flowability and the stabilization of the durability, inorganic fine particles having a BET specific surface area in the above ranges may be used in combination.

It is preferred that the external additive is used in an amount of 0.1 part by mass or more and 10.0 parts by mass or less based on 100 parts by mass of the toner particles. For mixing the toner particles and the external additive, a mixer such as a Henschel mixer may be used.

The toner can also be used as a single-component type developer, but in order to further improve the dot reproducibility, it is preferred to mix the toner with a magnetic carrier and to use the resultant mixture as a two-component type developer. Further, this is also preferred from the viewpoint that a stable image can be obtained over a long period of time.

As the magnetic carrier, for example, iron powder obtained by oxidizing the surface thereof, or unoxidized iron powder, particles of a metal such as iron, lithium, calcium, magnesium, nickel, copper, zinc, cobalt, manganese, chrome, or rare earths, particles of an alloy thereof, magnetic material particles such as oxide particles, and ferrite particles, a magnetic material-dispersed resin carrier (so-called resin carrier) that contains a magnetic material and a binder resin holding the magnetic material in a dispersed state, and the like can be used.

In a case where the toner is mixed with a magnetic carrier and the resultant mixture is used as a two-component type developer, the carrier mixing ratio at that time is preferably 2% by mass or more and 15% by mass or less, and more preferably 4% by mass or more and 13% by mass or less as the concentration of the toner in the two-component type developer.

<Production Method>

A procedure for producing the toner by the pulverization method is described below.

In a raw material mixing step, as the materials constituting toner particles, predetermined amounts of a binder resin, a low molecular aromatic hydrocarbon, a coloring agent, and a hydrocarbon wax are weighed and mixed. Examples of the mixing device include a double cone mixer, a V-type mixer, a drum-type mixer, a super mixer, a Henschel mixer, a Nauta mixer, and a Mechano Hybrid (manufactured by Mitsui Mining Co., Ltd.).

Next, the materials thus mixed are melt-kneaded to disperse the coloring agent and the like in the binder resin. In this melt-kneading step, a batch-type kneading machine such as a pressure kneader, or a Banbury mixer, or a continuous-type kneading machine may be used, and a single-screw or twin-screw extruder has become the mainstream because of an advantage in enabling continuous production. For example, a KTK-type twin-screw extruder (manufactured by Kobe Steel, Ltd.), a TEM-type twin-screw extruder (manufactured by TOSHIBA MACHINE CO., LTD.), a PCM kneader (manufactured by Ikegai Tekko Co., Ltd.), a twin-screw extruder (manufactured by KCK Co., Ltd), a co-kneader (manufactured by Coperion Buss Ag.), or Kneadex (manufactured by Mitsui Mining Co., Ltd.) is used.

Further, a colored resin composition obtained by the melt kneading may be rolled out by a twin-roll mill or the like, and then cooled in a cooling step by using water or the like.

Subsequently, the cooled kneaded material is pulverized until a desired particle diameter is obtained in a pulverizing step. In the pulverizing step, the cooled kneaded material is coarsely pulverized, for example, by a pulverizer such as a crusher, a hammer mill, or a feather mill, and then further finely pulverized, for example, by a KRYPTRON system (manufactured by Kawasaki Heavy Industries, Ltd.), Super Rotor (manufactured by NISSHIN ENGINEERING INC.), Turbo Mill (manufactured by Turbo Kogyo Co., Ltd.), or a fine grinding mill with an air-jet system.

After that, if necessary, the pulverized material is classified by using a classifier such as Elbow jet (manufactured by Nittetsu Mining Co., Ltd.) with an inertial classification system, Truboplex (manufactured by Hosokawa Micron Corporation) with a centrifugal force classification system, a TSP separator (manufactured by Hosokawa Micron Corporation), FACULTY (manufactured by Hosokawa Micron Corporation), or a sieving machine, to obtain toner particles.

Further, if necessary, after the pulverization, a surface modification treatment of toner particles, which is treated by a Hybridization system (manufactured by Nara Machinery Co., Ltd.), or a MECHANO FUSION System (manufactured by Hosokawa Micron Corporation), and further applying heat, may be performed. In a heat treatment step, from the viewpoint of the suppression of the coalescence of toner particles and the uniformity of the shape in the heat treatment step, it is more preferred to utilize hot air. For example, toner can be obtained by performing a surface treatment with hot air using the surface treatment device shown in FIGURE, and performing classification as needed.

The mixture quantitatively supplied by a raw material quantitative supply unit 1 is led into an introduction pipe 3 installed on a vertical line of the raw material supply unit by a compressed gas adjusted by the compressed gas adjustment unit 2. The mixture passed through the introduction pipe is uniformly dispersed by a conical projecting member 4 provided in the central part of the raw material supply unit, led into a supply pipe 5 extending radially in eight directions, and led into a treatment chamber 6 where a heat treatment is performed.

At this time, the flow of the mixture supplied to the treatment chamber is regulated by a regulating unit 9 for regulation of flow of a mixture, which is provided in the treatment chamber. Therefore, the mixture supplied to the treatment chamber is heat-treated while turning in the treatment chamber, and then cooled.

Heat for the heat treatment of the supplied mixture is supplied from a hot air supply unit 7, distributed by a distribution member 12, and hot air is introduced by being spirally swirled into the treatment chamber with a swirling member 13 for swirling hot air. As the configuration, the swirling member 13 for swirling hot air has multiple blades, and the swirling of hot air can be controlled by the number or angle of the blades. The temperature of the hot air to be supplied into the treatment chamber at the outlet of the hot air supply unit 7 is preferably 100° C. or more and 300° C. or less, and more preferably 130° C. or more and 170° C. or less. If the temperature at the outlet of the hot air supply unit is within the above range, toner particles can be uniformly spheroidized while preventing the fusion and coalescence of the toner particles due to the excessive heating for the mixture. The circularity at this time is preferably 0.955 or more and 0.980 or less. The hot air is supplied from a hot air supply unit outlet 11.

Further, the heat-treated toner particles that have been heat-treated are cooled by the cold air supplied from a cold air supply unit 8, and the temperature of the cold air supplied from the cold air supply unit 8 is preferably −20° C. to 30° C. If the temperature of the cold air is within the above range, the heat-treated toner particles can be efficiently cooled, and the fusion and coalescence of the heat-treated toner particles can be prevented without inhibiting the uniform spheroidization treatment of the mixture. The absolute moisture content of the cold air is preferably 0.5 $g/m^3$ or more and 15.0 $g/m^3$ or less.

Next, the cooled heat-treated toner particles are recovered by a recovery unit 10 at the lower end of the treatment chamber. Note that a blower (not shown) is provided at the end of the recovery unit, and by the blower, the cooled heat-treated toner particles are sucked and conveyed.

In addition, a powder particle supply port 14 is provided such that the turn direction of the supplied mixture and the swirl direction of the hot air are the same direction as each other, and the recovery unit 10 of the surface treatment device is provided in the outer peripheral part of the treatment chamber so that the swirl direction of the swirled powder particles is maintained. Further, the surface treatment device is configured such that the cold air supplied from the cold air supply unit 8 is supplied from the horizontal and tangential direction onto a circumferential surface in the treatment chamber from the outer peripheral part of the device. The turn direction of the toner particles before heat treatment supplied from the powder supply port, the swirl direction of the cold air supplied from the cold air supply unit, and the swirl direction of the hot air supplied from the hot air supply unit are all in the same direction as one another. Accordingly, turbulence does not occur in the treatment chamber, the swirling flow in the device is enhanced, a strong centrifugal force is applied to the toner particles before heat treatment, and the dispersibility of the toner particles before heat treatment is further improved, therefore, heat-treated toner particles having uniform shape with fewer coalesced particles can be obtained.

<Measurement of Glass Transition Temperature (Tg) of Resin>

A glass transition temperature (Tg) of a resin is measured using a differential scanning calorimetry analyzer "Q1000" (manufactured by TA Instruments Japan Inc.) in accordance with ASTM D3418-82.

The melting points of indium and zinc are used for temperature correction of the device detection part, and heat of fusion of indium is used for correction of the heat quantity.

Specifically, around 5 mg of a resin is precisely weighed and placed in an aluminum pan, using an empty aluminum pan as a reference, and measurement is performed at a temperature rise rate of 10° C./min in the measurement range of 30° C. to 200° C. The temperature is raised to 180° C. and kept for 10 minutes once, then lowered to 30° C., and then raised again. In this second temperature rising process, a change in specific heat is obtained in the temperature range of 30° C. to 100° C. At this time, the intersection of the line at the midpoint of the baseline before and after the change in specific heat and the differential thermal curve is taken as the glass transition temperature (Tg) of the resin.

<Measurement Method of Number Average Molecular Weight of Resin by GPC>

The molecular weight distribution of the THF soluble part of a resin is measured by gel permeation chromatography (GPC) as described below.

Firstly, toner is dissolved in tetrahydrofuran (THF) at room temperature over 24 hours. Subsequently, the obtained solution is filtered through a solvent resistant membrane filter "MyShoriDisk" (manufactured by TOSOH CORPORATION) having a pore diameter of 0.2 μm to obtain a sample solution. In addition, the sample solution is adjusted so that the concentration of the component soluble in THF is around 0.8% by mass. Using this sample solution, measurement is performed under the following conditions.

Device: HLC8120 GPC (detector: RI) (manufactured by TOSOH CORPORATION)

Column: combination of seven columns of Shodex KF-801, 802, 803, 804, 805, 806, and 807 (manufactured by SHOWA DENKO K.K.)

Eluent: tetrahydrofuran (THF)

Flow rate: 1.0 ml/min

Oven temperature: 40.0° C.

Amount of sample injected: 0.10 ml

When calculating the molecular weight of the sample, a molecular weight calibration curve created by using a standard polystyrene resin (for example, trade name "TSK Standard Polystyrene F-850, F-450, F-288, F-128, F-80, F-40, F-20, F-10, F-4, F-2, F-1, A-5000, A-2500, A-1000, or A-500", manufactured by TOSOH CORPORATION) is used.

<Measurement Method of Softening Point of Resin>

The softening point of a resin is measured by using a constant load extrusion type capillary rheometer "flow characteristic evaluating device Flowtester CFT-500D" (manufactured by Shimadzu Corporation) in accordance with the manual attached to the device. In the present device, while applying a constant load from the top of a measurement sample by a piston, the measurement sample filled in a cylinder is heated to be melted, the melted measurement sample is extruded from a die at the bottom of the cylinder, and a flow curve showing the relationship between the piston descent amount and the temperature at this time can be obtained.

In the present invention, the "melting temperature in ½ method" described in the manual attached to the "flow characteristic evaluating device Flowtester CFT-500D" is taken as the softening point. In addition, the melting temperature in ½ method is calculated as follows. At first, ½ of the difference between the descent amount Smax of the piston at the time when the outflow has completed and the descent amount Smin of the piston at the time when the outflow has started is determined (the ½ of the difference is defined as X, X=(Smax− Smin)/2). Subsequently, in the flow curve, the temperature of the flow curve when the descent amount of the piston becomes X is the melting temperature in ½ method.

As the measurement sample, a cylindrical sample having a diameter of around 8 mm, which is obtained by compression-molding around 1.0 g of a resin at around 10 MPa for around 60 seconds under the environment of 25° C. using a tablet compression machine (for example, NT-100H, manufactured by NPa SYSTEM CO., LTD.), is used.

Conditions for the measurement with CFT-500D are as follows:

Test mode: temperature rise method
Starting temperature: 50° C.
Reaching temperature: 200° C.
Measurement interval: 1.0° C.
Temperature rise rate: 4.0° C./min
Piston cross-sectional area: 1.000 $cm^2$
Test load (piston load): 10.0 kgf (0.9807 MPa)
Preheating time: 300 seconds
Diameter of hole of die: 1.0 mm
Length of die: 1.0 mm <Measurement Method of Resin Composition>

The content of the unit derived from an aromatic monocarboxylic acid or an aromatic monoalcohol in a resin is calculated from the integrated value of nuclear magnetic resonance spectroscopy ($^1$H-NMR) [400 MHz, $CDCl_3$, room temperature (25° C.)] spectrum.

Measurement device: FT NMR device JNM-EX400 (manufactured by JEOL Ltd.)
Measurement frequency: 400 MHz
Pulse condition: 5.0 μs
Frequency range: 10500 Hz
The number of times of integration: 64

<Measurement Method of Weight Average Particle Diameter (D4) of Toner Particles>

The weight average particle diameter (D4) of toner particles is calculated through analysis of the measurement data obtained by the measurement with 25000 effective measurement channels by using a precision particle size distribution measurement device "Coulter counter Multisizer 3" (registered trademark, manufactured by Beckman Coulter, Inc.) provided with a 100 μm aperture tube by a pore electrical resistance method, and the attached dedicated software "Beckman Coulter Multisizer 3 Version 3.51" (manufactured by Beckman Coulter, Inc.) for setting measurement conditions and analyzing measurement data.

The aqueous electrolyte solution to be used for measurement is a solution prepared by dissolving special grade sodium chloride in ion exchanged water so that the concentration is around 1% by mass, for example, "ISOTON II" (manufactured by Beckman Coulter, Inc.) may be used.

Note that the dedicated software is set as follows before performing the measurement and analysis.

On the "Changing standard operating method (SOM)" screen of the dedicated software, the total count number for the control mode is set to 50000 particles, the number of measurements is set to 1, and the value obtained by using "10.0 μm standard particles" (manufactured by Beckman Coulter, Inc.) is set for the Kd value. A threshold and a noise level are automatically set by pressing a button for measurement of the threshold/noise level. Further, the current is set to 1600 μA, the gain is set to 2, the electrolyte solution is set to ISOTON II, and flush of the aperture tube after measurement is checked.

On the "Setting of conversion from pulse to particle diameter" screen of the dedicated software, the bin interval is set to logarithmic particle diameter, the particle diameter bin is set to 256 particle diameter bins, and the particle diameter range is set to 2 μm or more and 60 μm or less.

The specific measurement method is as follows.

(1) Into a 250-mL round-bottom glass beaker specialized for Multisizer 3, around 200 ml of the aqueous electrolyte solution is placed, the beaker is set in a sample stand, and counterclockwise stirring with a stirrer rod is performed at 24 revolutions/sec. Further, contamination and air bubbles in the aperture tube are removed by an "Aperture flush" function of the dedicated software.

(2) Into a 100-mL flat-bottom glass beaker, around 30 ml of the aqueous electrolyte solution is placed, and as a dispersant, around 0.3 ml of a diluent prepared by diluting "Contaminon N" (a 10% by mass aqueous solution of a neutral detergent for washing a precision measuring device, which has a pH of 7, and is formed of a nonionic surfactant, an anionic surfactant, and an organic builder, manufactured by Wako Pure Chemical Industries, Ltd.) 3 times by mass with ion exchanged water is added.

(3) A predetermined amount of ion exchanged water is placed in a water tank of an ultrasonic disperser "Ultrasonic Dispension System Tetora 150" (manufactured by Nikkaki Bios Co., Ltd.) with an electrical output of 120 W, in which two oscillators with an oscillation frequency of 50 kHz are installed with the phases shifted by 180 degrees from each other, and around 2 ml of the Contaminon N described above is added to this water tank.

(4) The beaker of the above-described (2) is set in a beaker fixing hole of the ultrasonic disperser, and the ultrasonic disperser is operated. Subsequently, the height position of the beaker is adjusted so that the resonance state of a liquid surface of the aqueous electrolyte solution in the beaker becomes the maximum level.

(5) In a state in which the aqueous electrolyte solution in the beaker of the above-described (4) is irradiated with ultrasonic waves, around 10 mg of toner is added gradually to the aqueous electrolyte solution, and dispersed. Subsequently, the ultrasonic dispersion treatment is continued for further 60 seconds. In this regard, in the ultrasonic dispersion, the water temperature of the water tank is appropriately adjusted so as to be 10° C. or more and 40° C. or less.

(6) The aqueous electrolyte solution of the above-described (5), in which toner has been dispersed, is added dropwise into the round-bottom beaker of the above-described (1) set in a sample stand by using a pipette so that the measured concentration is adjusted to be around 5%. Further, the measurement is performed until the number of measured particles reached 50,000.

(7) The weight average particle diameter (D4) is calculated by analyzing the measurement data with the dedicated software attached to the device. In this regard, an "average diameter" on an Analysis/volume statistical value (arithmetic average) screen when graph/% by volume is set in the dedicated software is the weight average particle diameter (D4).

<Measurement Method of Average Circularity>

The average circularity of toner particles is measured by a flow-type particle image analyzer "FPIA-3000" (manufactured by SYSMEX CORPORATION) under the same measurement and analysis conditions as those for the calibration work.

The specific measurement method is as follows. Firstly, around 20 ml of ion exchanged water from which impure solids and the like have been removed in advance is placed in a glass container. Into the glass container, as a dispersant, around 0.2 ml of a diluent prepared by diluting "Contaminon N" (a 10% by mass aqueous solution of a neutral detergent for washing a precision measuring device, which has a pH of 7, and is formed of a nonionic surfactant, an anionic surfactant, and an organic builder, manufactured by Wako Pure Chemical Industries, Ltd.) around 3 times by mass with ion exchanged water is added. Further, around 0.02 g of the measurement sample is added, and the resultant mixture is subjected to a dispersion treatment for 2 minutes using an ultrasonic disperser to obtain a dispersion for measurement. At that time, the dispersion is appropriately cooled so as to have a temperature of 10° C. or more and 40° C. or less. As the ultrasonic disperser, a desktop ultrasonic cleaner disperser ("VS-150" (manufactured by VELVO-CLEAR)) having an oscillation frequency of 50 kHz and an electrical output of 150 W is used. In a water tank, a predetermined amount of ion exchange water is placed, and around 2 ml of the Contaminon N is added to the water tank.

In the measurement, the above flow-type particle image analyzer having the standard objective lens (magnification: 10 times) mounted thereon is used, and particle sheath "PSE-900A" (manufactured by SYSMEX CORPORATION) is used as a sheath fluid. The dispersion that has been adjusted according to the above procedure is introduced into the flow-type particle image analyzer, and in a HPF measurement mode, 3000 toner particles are measured in a total count mode. Subsequently, the binarization threshold during the particle analysis is set to 85%, the diameter of particles to be analyzed is limited to a circle-equivalent diameter of 1.985 μm or more and less than 39.69 μm, and the average circularity of toner particles is determined.

In this measurement, before the start of measurement, automatic focus adjustment is performed by using standard latex particles (prepared by diluting "RESEARCH AND TEST PARTICLES Latex Microsphere Suspensions 5200A" manufactured by Duke Scientific Corporation with ion exchanged water). After that, it is preferred to perform the focus adjustment every two hours after the start of measurement.

Note that in the present Examples, a flow-type particle image analyzer for which a calibration work has been performed by SYSMEX CORPORATION and a calibration certificate has been issued by SYSMEX CORPORATION was used. Measurement was performed under the same measurement and analysis conditions as those at the time when the calibration certificate had been issued except that the diameter of particles to be analyzed was limited to a circle-equivalent diameter of 1.985 μm or more and less than 39.69 μm.

<Low Molecular Aromatic Hydrocarbon>

The structures and melting points of the low molecular aromatic hydrocarbons used in the present Examples were shown in the following Table 1.

TABLE 1

| Compound No. | Name | Structure | Melting point |
|---|---|---|---|
| Compound 1 | m-Terphenyl | 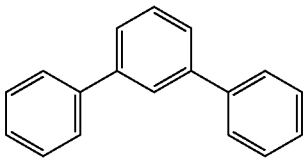 | 86 |
| Compound 2 | 9-Methylanthracene | 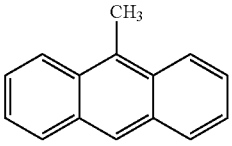  | 78 |
| Compound 3 | Triphenylethylene | 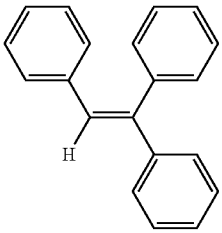  | 70 |

TABLE 1-continued
| Compound No. | Name | Structure | Melting point |
|---|---|---|---|
| Compound 4 | 3-Methylphenanthrene | 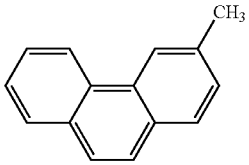 | 64 |
| Compound 5 | Durene | 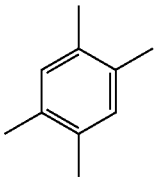 | 79 |
| Compound 6 | Prehnitol | 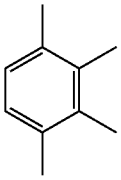 | 80 |
| Compound 7 | 1,2,3,4,5,6,7,8-Octahydroanthracene | 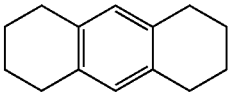 | 78 |
| Compound 8 | Naphthalene | 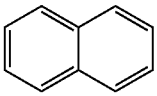 | 80 |
| Compound 9 | Diphenylacetylene | 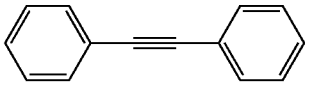 | 62 |
| Compound 10 | (E)-1,2-Bis(2-methylphenyl)ethene | 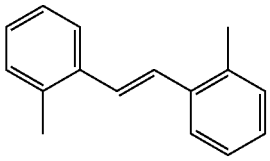 | 83 |
| Compound 11 | Biphenyl | 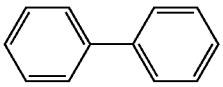 | 69 |
| Compound 12 | 1,2-Bis(2-methylphenyl)ethane | 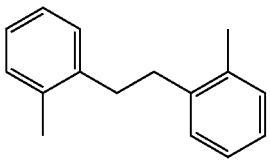 | 67 |
| Compound 13 | 1,2-Bis(4-methylphenyl)ethane | 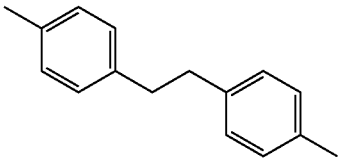 | 82 |

TABLE 1-continued

| Compound No. | Name | Structure | Melting point |
|---|---|---|---|
| Compound 14 | o,o'-Quaterphenyl | | 118 |
| Compound 15 | 5-Methylchrysene | $CH_3$ | 118.5 |
| Compound 16 | Phenanthrene | | 100 |
| Compound 17 | Triphenylene | | 198 |
| Compound 18 | Dibenz[a,h]anthracene | | 196 |

<Production Example of Amorphous Polyester Resin A1>

A 5-L four-neck flask equipped with a nitrogen introduction pipe, a cooling pipe, a stirrer, and a thermocouple was replaced with nitrogen, and then into the flask, a raw material monomer shown in Table 2 and tin(II) octylate were charged, and the resultant mixture was reacted for 10 hours after raising the temperature to 180° C. The reaction was further conducted at 15 mmHg for 5 hours, and then as a second reaction step, trimellitic anhydride and benzoic acid were added in accordance with Table 2, and the resultant mixture was reacted at 180° C. for 3 hours to obtain an amorphous polyester resin A1. Properties of the resin were shown in Table 2.

<Production Example of Amorphous Polyester Resins A2, A3, and B1>

Resins A2, A3, and B1 were synthesized in substantially the similar manner as in the Production example of an amorphous polyester resin A1 except that the raw material shown in Table 2 was used and the reaction was terminated after confirming that the softening point as measured in accordance with ASTM D36-86 reached the desired temperature shown in Table 2 in the second reaction step, in the Production example of a resin A1. Properties of the resin were shown in Table 2.

TABLE 2

| Production method and properties of resin | | | | | | | | | | |
|---|---|---|---|---|---|---|---|---|---|---|
| | Polyhydric alcohol component | | | Polyhydric alcohol component | | | Polyvalent carboxylic acid component | | | |
| | Used in first reaction step Monomer | | | Used in first reaction step Monomer | | | Used in first reaction step Monomer | | Used in second reaction step Monomer | |
| | Addition | | | Addition | | | | | | |
| Resin | Type | mole number | mol % [%] | Type | mole number | mol % [%] | Type | mol % [%] | Type | mol % [%] |
| A1 | BPA-PO | 2.7 | 60 | — | — | — | TPA | 40 | Anhydrous TMA | 0.04 |
| A2 | BPB-PO | 2.5 | 60 | — | — | — | TPA | 40 | Anhydrous TMA | 0.04 |
| A3 | BPB-PO | 2.5 | 60 | — | — | — | TPA | 40 | Anhydrous TMA | 0.04 |
| A4 | BPA-PO | 2.7 | 60 | — | — | — | TPA | 40 | Anhydrous TMA | 0.04 |
| B1 | BPA-PO | 2.7 | 57 | BPA-EO | 20 | 3 | TPA | 40 | Anhydrous TMA | 0.04 |

| | Aromatic monocarboxylic acid (alcohol) component Used in second reaction step Monomer | | Unit content derived from aromatic monocarboxylic acid (alcohol) | Properties | | |
|---|---|---|---|---|---|---|
| Resin | Type | mol % [%] | % | Mn | Tg [° C.] | Tm [° C.] |
| A1 | BA | 10 | 5.0 | 2300 | 50 | 82 |
| A2 | NA | 10 | 8.0 | 2600 | 53 | 86 |
| A3 | P | 10 | 2.0 | 2700 | 56 | 88 |
| A4 | — | — | — | 2400 | 51 | 84 |
| B1 | — | — | — | 5700 | 60 | 105 |

BPA-PO Propylene oxide adduct of bisphenol A (average addition mole number: 2.7 mol)
BPA-EO Ethylene oxide adduct of bisphenol A (average addition mole number: 2.0 mol)
BPB-PO Propylene oxide adduct of bisphenol B (average addition mole number: 2.5 mol)
TPA Terephthalic acid
Anhydrous TMA Trimellitic anhydride
BA Benzoic acid
NA Naphthoic acid
P Phenol <Production Example of Toner 1>

| | |
|---|---|
| Amorphous polyester resin A1 | 70.0 parts by mass |
| Amorphous polyester resin B1 | 30.0 parts by mass |
| Compound 1 | 3.0 parts by mass |
| Wax (FNP0090, manufactured by NIPPON SEIRO CO., LTD.) | 5.0 parts by mass |
| Pigment Blue 15:3 | 9.0 parts by mass |
| 3,5-di-t-butyl salicylic acid aluminum compound (BONTRON E88 manufactured by ORIENT CHEMICAL INDUSTRIES CO., LTD.) | 0.3 part by mass |

The above materials were mixed at a rotation speed of 20 $sec^{-1}$ and a rotation time of 5 minutes using a Henschel mixer (FM-75 type, manufactured by Mitsui Mining Co., Ltd.), and then kneaded by a twin-screw kneader (PCM-30 type, manufactured by Ikegai Tekko Co., Ltd.) set at a temperature of 140° C. The obtained kneaded material was cooled, and the cooled material was coarsely crushed to 1 mm or less with a hammer mill to obtain a coarse crushed material. The obtained coarse crushed material was finely pulverized with a mechanical pulverizer (T-250, manufactured by Turbo Kogyo Co., Ltd.). Further, classification was performed by using FACULTY F-300 (manufactured by Hosokawa Micron Corporation) to obtain toner particles 1. As the operating conditions, the classification rotor speed was set to 130 $sec^{-1}$, and the dispersion rotor speed was set to 120 $sec^{-1}$. In addition, the fine particle side powder separated from the toner particles 1 in the classification step was separately recovered, and was subjected to analysis.

By using the obtained toner particles 1, a treatment was performed by a surface treatment device shown in FIGURE to obtain heat-treated toner particles. As the operating conditions, feed amount=5 kg/hour, hot air temperature=170° C., hot air flow rate=6 $m^3$/min, cold air temperature=−5° C., cold air flow rate=4 $m^3$/min, blower flow rate=20 $m^3$/min, and injection air flow rate=1 $m^3$/min were used.

Into 100 parts by mass of the heat-treated toner particles, 1.0 part by mass of hydrophobic silica (BET specific surface area (nitrogen adsorption specific surface area): 200 $m^2$/g), and 1.0 part by mass of titanium oxide fine particles that had been surface-treated with isobutyltrimethoxysilane (BET specific surface area (nitrogen adsorption specific surface area): 80 $m^2$/g) were mixed at a rotation speed of 30 $sec^{-1}$ and a rotation time of 10 minutes using a Henschel mixer (FM-75 type, manufactured by Mitsui Miike Chemical Engineering Machinery, Co., Ltd.) to obtain toner 1. The weight average particle diameter (D4) of toner 1 was 6.4 μm, and the average circularity was 0.965. The properties of toner were shown in Table 3.

<Production Example of Toners 2 to 23>

Toners 2 to 23 were obtained in substantially the similar manner as in the Production example of toner 1 except that the materials described in Table 3 were mixed for the preparation in accordance with Table 3 in the Production Example of toner 1.

TABLE 3

| | Resin | | | | Low molecular aromatic hydrocarbon | | Wax | | Other additive agents | | | | | |
|---|---|---|---|---|---|---|---|---|---|---|---|---|---|---|
| | | Number of parts added | | Number of parts added | | Number of parts added | | Number of parts added | | Number of parts added | | Number of parts added | D4 [μm] | Average circularity |
| Toner 1 | A1 | 70 | B1 | 30 | Compound 1 | 3.00 | FNP0090 | 5.0 | PB15:3 | 9.0 | BONTRON | 0.3 | 6.4 | 0.965 |
| Toner 2 | A1 | 75 | B1 | 25 | Compound 1 | 1.00 | FNP0090 | 5.0 | PB15:3 | 9.0 | BONTRON | 0.3 | 6.4 | 0.966 |
| Toner 3 | A1 | 65 | B1 | 35 | Compound 1 | 5.00 | FNP0090 | 5.0 | PB15:3 | 9.0 | BONTRON | 0.3 | 6.4 | 0.965 |
| Toner 4 | A1 | 80 | B1 | 20 | Compound 1 | 0.10 | FNP0090 | 5.0 | PB15:3 | 9.0 | BONTRON | 0.3 | 6.4 | 0.965 |
| Toner 5 | A1 | 60 | B1 | 40 | Compound 1 | 10.0 | FNP0090 | 5.0 | PB15:3 | 9.0 | BONTRON | 0.3 | 6.4 | 0.965 |
| Toner 6 | A2 | 70 | B1 | 30 | Compound 2 | 0.05 | FNP0090 | 5.0 | PB15:3 | 9.0 | BONTRON | 0.3 | 6.4 | 0.965 |
| Toner 7 | A2 | 70 | B1 | 30 | Compound 3 | 0.05 | FNP0090 | 5.0 | PB15:3 | 9.0 | BONTRON | 0.3 | 6.5 | 0.965 |
| Toner 8 | A2 | 70 | B1 | 30 | Compound 4 | 0.05 | FNP0090 | 5.0 | PB15:3 | 9.0 | BONTRON | 0.3 | 6.4 | 0.965 |
| Toner 9 | A2 | 70 | B1 | 30 | Compound 5 | 0.05 | FNP0090 | 5.0 | PB15:3 | 9.0 | BONTRON | 0.3 | 6.4 | 0.964 |
| Toner 10 | A2 | 70 | B1 | 30 | Compound 6 | 0.05 | FNP0090 | 5.0 | PB15:3 | 9.0 | BONTRON | 0.3 | 6.4 | 0.965 |
| Toner 11 | A2 | 70 | B1 | 30 | Compound 7 | 0.05 | FNP0090 | 5.0 | PB15:3 | 9.0 | BONTRON | 0.3 | 6.4 | 0.965 |
| Toner 12 | A2 | 70 | B1 | 30 | Compound 8 | 0.05 | FNP0090 | 5.0 | PB15:3 | 9.0 | BONTRON | 0.3 | 6.4 | 0.965 |
| Toner 13 | A2 | 70 | B1 | 30 | Compound 9 | 0.05 | FNP0090 | 5.0 | PB15:3 | 9.0 | BONTRON | 0.3 | 6.4 | 0.965 |
| Toner 14 | A2 | 70 | B1 | 30 | Compound 10 | 0.05 | FNP0090 | 5.0 | PB15:3 | 9.0 | BONTRON | 0.3 | 6.4 | 0.965 |
| Toner 15 | A2 | 70 | B1 | 30 | Compound 11 | 0.05 | FNP0090 | 5.0 | PB15:3 | 9.0 | BONTRON | 0.3 | 6.3 | 0.965 |
| Toner 16 | A2 | 70 | B1 | 30 | Compound 12 | 0.05 | FNP0090 | 5.0 | PB15:3 | 9.0 | BONTRON | 0.3 | 6.4 | 0.965 |
| Toner 17 | A2 | 70 | B1 | 30 | Compound 13 | 0.05 | FNP0090 | 5.0 | PB15:3 | 9.0 | BONTRON | 0.3 | 6.4 | 0.965 |
| Toner 18 | A2 | 70 | B1 | 30 | Compound 14 | 0.05 | FNP0090 | 5.0 | PB15:3 | 9.0 | BONTRON | 0.3 | 6.4 | 0.966 |
| Toner 19 | A2 | 70 | B1 | 30 | Compound 15 | 12.0 | FNP0090 | 5.0 | PB15:3 | 9.0 | BONTRON | 0.3 | 6.4 | 0.965 |
| Toner 20 | A3 | 70 | B1 | 30 | Compound 16 | 12.0 | FNP0090 | 5.0 | PB15:3 | 9.0 | BONTRON | 0.3 | 6.4 | 0.965 |
| Toner 21 | A1 | 70 | B1 | 30 | Compound 17 | 3.00 | FNP0090 | 5.0 | PB15:3 | 9.0 | BONTRON | 0.3 | 6.4 | 0.965 |
| Toner 22 | A1 | 70 | B1 | 30 | Compound 18 | 3.00 | FNP0090 | 5.0 | PB15:3 | 9.0 | BONTRON | 0.3 | 6.4 | 0.965 |
| Toner 23 | A4 | 70 | B1 | 30 | Compound 1 | 3.00 | FNP0090 | 5.0 | PB15:3 | 9.0 | BONTRON | 0.3 | 6.4 | 0.965 |

<Production of Magnetic Core Particles 1>

Step 1 (Weighing and Mixing Step):

| | |
|---|---|
| $Fe_2O_3$ | 62.7 parts by mass |
| $MnCO_3$ | 29.5 parts by mass |
| $Mg(OH)_2$ | 6.8 parts by mass |
| $SrCO_3$ | 1.0 part by mass |

As ferrite raw materials, the above materials were weighed so as to have the above composition ratio. After that, the materials were pulverized and mixed for 5 hours with a dry vibration mill using stainless steel beads having a diameter of ⅛ inch.

Step 2 (Calcination Step):

The obtained pulverized material was made into pellets of around 1 mm square by a roller compactor. From the pellets, the coarse powder was removed with a vibration sieve having an opening of 3 mm, subsequently the fine powder was removed with a vibration sieve having an opening of 0.5 mm, and then the firing was performed for the pellets at a temperature of 1000° C. for 4 hours under a nitrogen atmosphere (oxygen concentration: 0.01% by volume) by using a burner type kiln to prepare calcined ferrite. The composition of the obtained calcined ferrite is as follows.

$$(MnO)_a(MgO)_b(SrO)_c(Fe_2O_3)_d$$

in the above formula, a=0.257, b=0.117, c=0.007, and d=0.393.

Step 3 (Pulverizing Step):

The prepared calcined ferrite was pulverized to around 0.3 mm with a crusher, then to the resultant pulverized calcined ferrite, 30 parts by mass of water was added based on 100 parts by mass of the calcined ferrite, and the resultant mixture was pulverized for 1 hour with a wet ball mill using zirconia beads having a diameter of ⅛ inch. The obtained slurry was pulverized for 4 hours with a wet ball mill using alumina beads having a diameter of 1/16 inch to obtain a ferrite slurry (finely pulverized product of calcined ferrite).

Step 4 (Granulating Step):

Into the ferrite slurry, 1.0 part by mass of ammonium polycarboxylate as a dispersant and 2.0 parts by mass of polyvinyl alcohol as a binder were added based on 100 parts by mass of the calcined ferrite, and the resultant mixture was granulated into spherical particles with a spray dryer (manufacturer: OHKAWARA KAKOHKI CO., LTD.). After adjusting the particle size of the obtained particles, the particles were heated at 650° C. for 2 hours to remove organic components of the dispersant or the binder using a rotary kiln.

Step 5 (Firing Step):

In order to control the firing atmosphere, the temperature was raised from room temperature to 1300° C. in 2 hours under a nitrogen atmosphere (oxygen concentration: 1.00% by volume) in an electric furnace, and then the particles were fired at a temperature of 1150° C. for 4 hours. After that, the temperature was lowered to a temperature of 60° C. over 4 hours, the nitrogen atmosphere was returned to the atmosphere, and the particles were taken out at a temperature of 40° C. or less.

Step 6 (Screening Step):

After the aggregated particles were disintegrated, low magnetic products were cut by magnetic separation, and the resultant particles were sieved with a sieve having an opening of 250 μm to remove coarse particles, and magnetic core particles 1 having a 50% particle diameter (D50) of 37.0 μm in a volume-based distribution were obtained.

<Preparation of Coating Resin 1>

| | |
|---|---|
| Cyclohexyl methacrylate monomer | 26.8% by mass |
| Methyl methacrylate monomer | 0.2% by mass |
| Methyl methacrylate macromonomer (macromonomer having a weight average molecular weight of | 8.4% by mass |

-continued

| | |
|---|---|
| 5000 with a methacryloyl group at one terminal) | |
| Toluene | 31.3% by mass |
| Methyl ethyl ketone | 31.3% by mass |
| Azobisisobutyronitrile | 2.0% by mass |

Among the above materials, cyclohexyl methacrylate, methyl methacrylate, methyl methacrylate macromonomer, toluene, and methyl ethyl ketone were placed in a four-neck separable flask equipped with a reflux condenser, a thermometer, a nitrogen introduction pipe, and a stirrer, and the inside of the system was replaced with nitrogen gas by introducing the nitrogen gas. After that, the resultant mixture was heated to 80° C., and azobisisobutyronitrile was added into the mixture, and the resultant mixture was refluxed for 5 hours for the polymerization. Hexane was injected into the obtained reactant to precipitate a copolymer, and the precipitate was filtered out, and then vacuum dried to obtain a coating resin 1. The obtained coating resin 1 in an amount of 30 parts by mass was dissolved in 40 parts by mass of toluene and 30 parts by mass of methyl ethyl ketone to obtain a polymer solution 1 (solid content: 30% by mass).

<Preparation of Coating Resin Solution 1>

| | |
|---|---|
| Polymer solution 1 (resin solid content concentration: 30%) | 33.3% by mass |
| Toluene | 66.4% by mass |
| Carbon black (Regal 330, manufactured by Cabot Corporation) (primary particle diameter: 25 nm, BET specific surface area (nitrogen adsorption specific surface area): 94 $m^2/g$, and DBP oil absorption: 75 ml/100 g) were dispersed for 1 hour with a paint shaker using zirconia beads having a diameter of 0.5 mm. The obtained dispersion was filtered by a membrane filter of 5.0 μm to obtain a coating resin solution 1. | 0.3% by mass |

<Production Example of Magnetic Carrier 1>

(Resin Coating Step):

Into a vacuum deaeration-type kneader maintained at room temperature, the coating resin solution 1 was charged as a resin component so as to be in an amount of 2.5 parts by mass based on 100 parts by mass of the magnetic core particles 1. After the charging, the resultant mixture was stirred at a rotation speed of 30 rpm for 15 minutes, and after a certain level or more (80% by mass) of the solvent was volatilized, the temperature was raised to 80° C. while mixing the mixture under reduced pressure, and the toluene was distilled off over 2 hours, and then the resultant mixture was cooled. Next, low magnetic products were separated by magnetic separation, then classification was performed with an air classifier after passing through a sieve having an opening of 70 μm, and a magnetic carrier 1 having a 50% particle diameter (D50) of 38.2 μm in a volume-based distribution was obtained.

<Production Example of Two-Component Type Developer 1>

Toner 1 in an amount of 9.0 parts by mass was added to 91.0 parts by mass of magnetic carrier 1, and the resultant mixture was mixed by a V-type mixer (V-20, manufactured by SEISHIN ENTERPRISE Co., Ltd.) to obtain a two-component type developer 1.

<Production Example of Two-Component Type Developers 2 to 22>

Two-component type developers 2 to 22 were obtained in the similar operation manner as in Production example of two-component type developer 1 except that the toner combination was changed as shown in Table 4.

Example 1

Evaluation was performed by using the two-component type developer 1.

A remodeled machine of a full-color copying machine imagePRESS C800 manufactured by Canon Inc. was used as the image forming device, a two-component type developer was placed in a cyan station, the DC voltage VDC of a developer bearing member, the charging voltage VD of an electrostatic latent image-bearing member, and the laser power were adjusted so that the toner laid-on level on the electrostatic latent image-bearing member or paper is a desired level, and evaluation described later was conducted. The remodeled point is that the fixing temperature and the process speed were changed so as to be freely set.

Evaluation was made on the basis of the following evaluation method, and the results are shown in Table 4.

<Evaluation 1: Blocking Resistance (Residual Ratio)>

Into a 100-mL plastic container Polycup, 5 g of toner was placed, then the Polycup was left to stand for 8 hours in a temperature and humidity variable thermostat (setting: 45° C., 80% RH), and after being left to stand, the cohesiveness of the toner was evaluated.

When the toner was sieved with a mesh having an opening of 20 μm for 10 seconds at an amplitude of 0.5 mm by a Powder Tester PT-X manufactured by Hosokawa Micron Corporation, the cohesiveness was evaluated by using a residual ratio of the remaining toner as an evaluation index.

(Evaluation Criteria)

A: Residual ratio is less than 3.0% (extremely excellent)

B: Residual ratio is 3.0% or more and less than 10.0% (favorable)

C: Residual ratio is 10.0% or more and less than 15.0% (conventional technique level)

D: Residual ratio is 15.0% or more (inferior to conventional)

<Evaluation 2: Chargeability (Charge Retention Ratio)>

The toner on an electrostatic latent image-bearing member was sucked and collected by using a metal cylindrical pipe and a cylindrical filter, and the triboelectric charge quantity of toner and the toner laid-on level were calculated. Specifically, the triboelectric charge quantity of toner and the toner laid-on level on the electrostatic latent image-bearing member were measured by a Faraday cage (Faraday-Cage).

The Faraday cage is a coaxial double cylinder, and of which the inner cylinder and the outer cylinder are insulated. If a charged body with a charge amount Q is placed in the inner cylinder, the situation becomes similar to a situation as if a metal cylinder with a charge amount Q is present by electrostatic induction. The induced charge amount was measured by an electrometer (KEITHLEY 6517A manufactured by Keithley Instruments Inc.), and (Q/M) obtained by dividing the charge amount Q (mC) by the toner mass M (kg) in the inner cylinder was taken as the triboelectric charge quantity of the toner.

In addition, the sucked area S was measured, and a value obtained by dividing the toner mass M by the sucked area S ($cm^2$) was taken as the toner laid-on level per unit area.

The toner was measured by stopping the rotation of an electrostatic latent image-bearing member before a toner layer formed on the electrostatic latent image-bearing member is transferred onto an intermediate transfer member, and by directly air sucking the toner image on the electrostatic latent image-bearing member.

Laid-on level of toner ($mg/cm^2$)=M/S

Triboelectric charge quantity of toner (mC/kg)=Q/M

The above image forming device was adjusted so that the toner laid-on level on the electrostatic latent image-bearing member is 0.30 $mg/cm^2$ under the environment of high temperature and high humidity (30.0° C., 72% RH), and the suction and collection were performed with the metal cylindrical pipe and the cylindrical filter. At that time, the charge amount Q stored in a capacitor through the metal cylindrical pipe, and the collected toner mass M were measured, the charge amount per unit mass Q/M (mC/kg) was calculated, and the obtained value was taken as the charge amount per unit mass Q/M (mC/kg) on the electrostatic latent image-bearing member (initial evaluation).

After performing the above evaluation (initial evaluation), the developing device was removed outside the machine, left to stand for 1 week under the environment of high temperature and high humidity (30.0° C., 72% RH), then mounted again inside the machine, and the charge amount per unit mass Q/M on the electrostatic latent image-bearing member was measured at the same DC voltage VDC as that in the initial evaluation (evaluation after being left).

The charge amount per unit mass Q/M on the electrostatic latent image-bearing member in the above initial evaluation was taken as 100%, the retention ratio (evaluation after being left/initial evaluation×100) of the charge amount per unit mass Q/M on the electrostatic latent image-bearing member after being left to stand for 1 week (evaluation after being left) was calculated, and evaluation was performed by the following criteria.

(Evaluation Criteria)

A: Retention ratio is 80% or more (excellent)

B: Retention ratio is 70% or more and less than 80% (slightly excellent)

C: Retention ratio is 60% or more and less than 70% (conventional technique level)

D: Retention ratio is less than 60% (inferior to conventional)

<Evaluation 3: Low-Temperature Fixability (Fixable Lower Limit Temperature)>

A developing device in which a two-component type developer 1 had been placed was installed in a cyan station of a remodeled machine of a full-color copying machine imagePRESS C800 manufactured by Canon Inc., the machine was remodeled so as to be able to form an image in a state in which a fixing device had been removed, and a toner image that had not been fixed on an evaluation paper sheet (hereinafter, referred to as an unfixed image) was formed. For the evaluation, plain paper for a color copying machine/printer, GF-C157 (A4, 157 $g/cm^2$, commercially available from Canon Marketing Japan Inc.) was used.

Practically, the developing conditions were appropriately adjusted so that the toner laid-on level of a FFH image (hereinafter, referred to as a solid part) on a paper sheet is 1.2 $mg/cm^2$, and an unfixed image of 2 cm×10 cm was formed at a position 3 cm from the tip of and in the center of an A4 longitudinal evaluation paper sheet. The unfixed image was conditioned for 24 hours under the environment of low humidity and low temperature (15° C./10% RH).

Subsequently, a fixing device was taken out from the full-color copying machine imagePRESS C800 manufactured by Canon Inc., and a fixing test fixture was prepared so that the process speed and the temperature of the upper and lower fixing members are independently controlled. In the evaluation of the fixability, the evaluation was performed under the environment of low temperature and low humidity (15° C./10% RH), and the fixing test fixture that had been adjusted to have a process speed of 400 mm/sec was used. In the actual evaluation, the evaluation was performed by feeding the unfixed image while adjusting the upper belt temperature in the fixing test fixture every 5° C. in the range of 100° C. to 200° C., and during that time, the lower belt temperature was in a state of being fixed at 100° C. The fixed image that had passed through the fixing device was rubbed back-and-forth five times with a lens-cleaning wiper (Dusper manufactured by OZU CORPORATION) applying a load of 4.9 kPa, and a point at which the density decreasing ratio between the image densities before and after the rubbing became 10% or less was taken to be the fixing temperature. Under the criteria that the image has not been fixed when the density decreasing exceeds 10%, the lowest upper belt set temperature at which the image density decreasing ratio does not exceed 10% was taken as the low-temperature fixing temperature, and the evaluation was performed in accordance with the following evaluation criteria.

(Evaluation Criteria: Low-Temperature Fixability)

| | |
|---|---|
| A: Less than 130° C. | (excellent) |
| B: 130° C. or more and less than 150° C. | (slightly excellent) |
| C: 150° C. or more and less than 160° C. | (conventional technique level) |
| D: 160° C. or more | (inferior to conventional) |

<Evaluation 4: Low-Temperature Fixability (Fixable Lower Limit Temperature)>

The two-component type developer was placed in a cyan station of a full-color copying machine imagePRESS C800 manufactured by Canon Inc., and evaluation of the toner scattering in a developing device was performed under the environment of high temperature and high humidity (30° C., 80% RH). After outputting 20,000 images with a chart having an image ratio of 45%, only the developing device was idled for 30 seconds in the main body of the image forming device, the toner attached to the opposing photoreceptor surface is collected by taping, and the collected amount was measured by a Photovolt reflection densitometer (trade name: TC-6DS/A, manufactured by Tokyo Denshoku CO., LTD.). Evaluation was performed in accordance with the following evaluation criteria. The evaluation results are shown in Table 3.

(Evaluation Criteria: Toner Scattering and Fog)

| | |
|---|---|
| A: Less than 5% | (extremely excellent) |
| B: 5% or more and less than 20% | (excellent) |
| C: 20% or more and less than 30% | (conventional technique level) |
| D: 30% or more | (inferior to conventional) |

Examples 2 to 20, and Comparative Examples 1 to 3

Evaluation was performed in the similar manner as in Example 1 using the developers 2 to 20 shown in Table 4, and Comparative Examples 1 to 3. The evaluation results are shown in Table 4.

TABLE 4

| | Two-component type developer | | | Fixability | | Charge retention after being left | |
|---|---|---|---|---|---|---|---|
| | | Toner | Magnetic carrier | Fixing lower limit temperature [° C.] | Evaluation | Initial stage Q/M [μQ/g] | After being left Q/M [μQ/g] |
| Example 1 | Two-component type developer 1 | Toner 1 | Magnetic carrier 1 | 115 | A | 40.2 | 35.3 |
| Example 2 | Two-component type developer 2 | Toner 2 | Magnetic carrier 1 | 115 | A | 42.1 | 34.6 |
| Example 3 | Two-component type developer 3 | Toner 3 | Magnetic carrier 1 | 110 | A | 39.6 | 33.2 |
| Example 4 | Two-component type developer 4 | Toner 4 | Magnetic carrier 1 | 110 | A | 40.1 | 34.7 |
| Example 5 | Two-component type developer 5 | Toner 5 | Magnetic carrier 1 | 120 | A | 40.3 | 33.2 |
| Example 6 | Two-component type developer 6 | Toner 6 | Magnetic carrier 1 | 110 | A | 38.0 | 32.4 |
| Example 7 | Two-component type developer 7 | Toner 7 | Magnetic carrier 1 | 120 | A | 38.5 | 31.6 |
| Example 8 | Two-component type developer 8 | Toner 8 | Magnetic carrier 1 | 115 | A | 36.5 | 30.2 |
| Example 9 | Two-component type developer 9 | Toner 9 | Magnetic carrier 1 | 125 | A | 37.6 | 30.9 |
| Example 10 | Two-component type developer 10 | Toner 10 | Magnetic carrier 1 | 120 | A | 43.1 | 33.1 |
| Example 11 | Two-component type developer 11 | Toner 11 | Magnetic carrier 1 | 125 | A | 45.2 | 34.5 |
| Example 12 | Two-component type developer 12 | Toner 12 | Magnetic carrier 1 | 120 | A | 43.1 | 31.2 |
| Example 13 | Two-component type developer 13 | Toner 13 | Magnetic carrier 1 | 110 | A | 43.6 | 34.1 |
| Example 14 | Two-component type developer 14 | Toner 14 | Magnetic carrier 1 | 125 | A | 44.2 | 32.1 |
| Example 15 | Two-component type developer 15 | Toner 15 | Magnetic carrier 1 | 120 | A | 44.9 | 33.4 |
| Example 16 | Two-component type developer 16 | Toner 16 | Magnetic carrier 1 | 125 | A | 44.1 | 33.4 |
| Example 17 | Two-component type developer 17 | Toner 17 | Magnetic carrier 1 | 115 | A | 44.4 | 32.4 |
| Example 18 | Two-component type developer 18 | Toner 18 | Magnetic carrier 1 | 135 | B | 42.3 | 31.9 |
| Example 19 | Two-component type developer 19 | Toner 19 | Magnetic carrier 1 | 140 | B | 43.3 | 31.0 |
| Example 20 | Two-component type developer 20 | Toner 20 | Magnetic carrier 1 | 135 | B | 45.3 | 33.4 |
| Comparative Example 1 | Two-component type developer 21 | Toner 21 | Magnetic carrier 1 | 140 | B | 43.1 | 26.8 |
| Comparative Example 2 | Two-component type developer 22 | Toner 22 | Magnetic carrier 1 | 155 | C | 40.2 | 31.4 |
| Comparative Example 3 | Two-component type developer 23 | Toner 23 | Magnetic carrier 1 | 120 | A | 39.8 | 29.4 |

| | Charge retention after being left | | Durable stability after development | | Storage stability | |
|---|---|---|---|---|---|---|
| | Retention ratio [%] | Evaluation | Scattering density [%] | Evaluation | Residual ratio [%] | Evaluation |
| Example 1 | 88 | A | 1.0 | A | 1.3 | A |
| Example 2 | 82 | A | 2.2 | A | 1.5 | A |
| Example 3 | 84 | A | 1.8 | A | 0.9 | A |
| Example 4 | 87 | A | 3.1 | A | 1.9 | A |
| Example 5 | 82 | A | 1.5 | A | 2.1 | A |
| Example 6 | 85 | A | 6.1 | B | 2.3 | A |
| Example 7 | 82 | A | 5.4 | B | 2.2 | A |
| Example 8 | 83 | A | 8.9 | B | 5.6 | B |
| Example 9 | 82 | A | 7.4 | B | 4.6 | B |
| Example 10 | 77 | B | 7.2 | B | 3.5 | B |
| Example 11 | 76 | B | 7.1 | B | 5.8 | B |
| Example 12 | 72 | B | 8.5 | B | 7.5 | B |
| Example 13 | 78 | B | 9.1 | B | 7.8 | B |
| Example 14 | 73 | B | 6.8 | B | 4.5 | B |
| Example 15 | 74 | B | 7.9 | B | 8.3 | B |

TABLE 4-continued

| | | | | | | |
|---|---|---|---|---|---|---|
| Example 16 | 76 | B | 8.4 | B | 8.4 | B |
| Example 17 | 73 | B | 7.4 | B | 8.5 | B |
| Example 18 | 75 | B | 10.4 | B | 6.3 | B |
| Example 19 | 72 | B | 11.8 | B | 9.0 | B |
| Example 20 | 74 | B | 15.4 | B | 9.1 | B |
| Comparative Example 1 | 62 | C | 21.4 | C | 12.3 | C |
| Comparative Example 2 | 78 | B | 18.1 | B | 2.1 | A |
| Comparative Example 3 | 74 | B | 32.4 | D | 16.4 | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-045568, filed Mar. 10, 2017, which is hereby incorporated by reference herein in its entirety.

What is claimed is:

1. A toner, comprising:

a toner particle containing a binder resin and a low molecular aromatic hydrocarbon, the binder resin containing a polyester resin that is a polycondensate of (i) an aromatic diol as a main component of an alcohol component, (ii) a polyvalent carboxylic acid, and (iii) at least one of an aromatic monocarboxylic acid and an aromatic monoalcohol, wherein the low molecular aromatic hydrocarbon has 1 to 4 benzene rings, and the low molecular aromatic hydrocarbon has a melting point of 60 to 120° C.

2. The toner according to claim 1, wherein the low molecular aromatic hydrocarbon contains at least one compound represented by any of formulae (1) to (9)

(1)

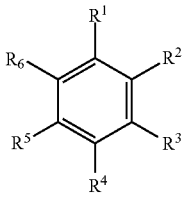

(2)

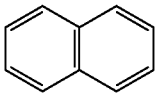

(3)

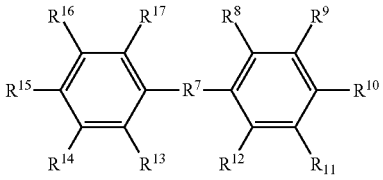

-continued (4)

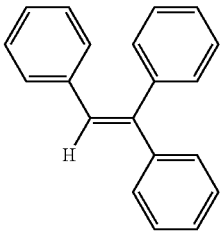

(5)

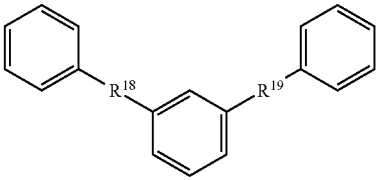

(6)

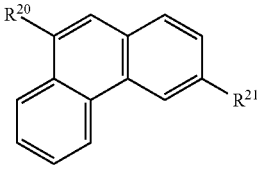

(7)

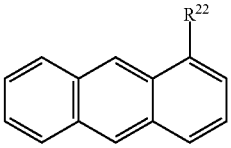

(8)

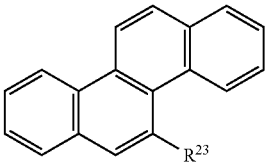

(9)

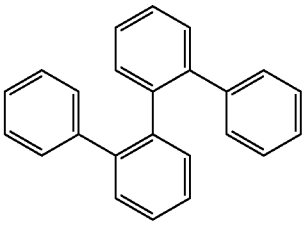

where $R^1$ to $R^6$, $R^8$ to $R^{17}$ and $R^{20}$ to $R^{23}$ independently represent a hydrogen atom, an alkyl group, or an alkenyl group, and $R^7$, $R^{18}$ and $R^{19}$ independently represent a single bond, an alkylene group or an alkenylene group.

3. The toner according to claim 1, wherein the low molecular aromatic compound is contained in an amount of 0.1 to 10.0 parts by mass based on 100 parts by mass of the binder resin.

4. The toner according to claim 1, wherein the aromatic monocarboxylic acid is a benzoic acid.

* * * * *